US010786125B1

(12) United States Patent
Whitlock

(10) Patent No.: US 10,786,125 B1
(45) Date of Patent: Sep. 29, 2020

(54) SANITIZING SYSTEM FOR TOILET-CLEANING IMPLEMENTS

(71) Applicant: Angela Whitlock, Rochester, NY (US)

(72) Inventor: Angela Whitlock, Rochester, NY (US)

( * ) Notice: Subject to any disclaimer, the term of this patent is extended or adjusted under 35 U.S.C. 154(b) by 267 days.

(21) Appl. No.: 16/018,146

(22) Filed: Jun. 26, 2018

(51) Int. Cl.

| | |
|---|---|
| ***A47K 11/10*** | (2006.01) |
| ***A61L 2/18*** | (2006.01) |
| ***A47K 17/00*** | (2006.01) |
| *A47K 5/12* | (2006.01) |
| *E03C 1/308* | (2006.01) |
| *E03D 9/06* | (2006.01) |

(52) U.S. Cl.
CPC ..... *A47K 11/10* (2013.01); *A47K 5/12* (2013.01); *E03C 1/308* (2013.01); *E03D 9/06* (2013.01)

(58) Field of Classification Search
CPC ..... A47K 11/10; A47K 17/00; A61L 2/18
USPC ..... 422/300
See application file for complete search history.

(56) References Cited

U.S. PATENT DOCUMENTS

| | | | | |
|---|---|---|---|---|
| 6,383,457 | B1 * | 5/2002 | Brown | A61L 2/18 134/42 |
| D471,393 | S | 3/2003 | Hutchinson | |
| 7,841,029 | B1 | 11/2010 | Williams | |
| 8,342,321 | B2 | 1/2013 | McAllan | |
| 8,510,874 | B2 | 8/2013 | Duboc | |
| 9,133,610 | B2 | 9/2015 | Dressel | |
| 2004/0159330 | A1 | 8/2004 | Anemone | |
| 2006/0213791 | A1 * | 9/2006 | Holden | E03C 1/308 206/349 |
| 2011/0253180 | A1 | 10/2011 | Davidson | |

FOREIGN PATENT DOCUMENTS

| | | |
|---|---|---|
| WO | 9923926 | 5/1999 |

* cited by examiner

*Primary Examiner* — Kevin Joyner
(74) *Attorney, Agent, or Firm* — Kyle A. Fletcher, Esq.

(57) ABSTRACT

The sanitizing system for toilet-cleaning implement is a cleaning apparatus. The sanitizing system for toilet-cleaning implement is configured for use with a cleaning tool. The cleaning tool is configured for use in cleaning toilets. The cleaning tool is further defined with a working element and a handle. The working element is selected from the group consisting of a brush and a plunger. The sanitizing system for toilet-cleaning implement stores the cleaning tool when the cleaning tool is not in use. The sanitizing system for toilet-cleaning implement comprises a container, liner, lid and disinfecting liquid. The disinfecting liquid is stored in the liner. The liner installs in the container. The cleaning tool inserts into the disinfecting liquid stored in the liner. The lid encloses the container.

19 Claims, 6 Drawing Sheets

SANITIZING SYSTEM FOR TOILET-CLEANING IMPLEMENTS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including sanitizing equipment, more specifically, a separate apparatus for deodorizing, disinfecting, or cleaning a toilet bowl, seat, or cover that does not require flushing.

SUMMARY OF INVENTION

The sanitizing system for toilet-cleaning implement is a cleaning apparatus. The sanitizing system for toilet-cleaning implement is configured for use with a cleaning tool. The cleaning tool is configured for use in cleaning toilets. The cleaning tool is further defined with a working element and a handle. The working element is selected from the group consisting of a brush and a plunger. The sanitizing system for toilet-cleaning implement stores the cleaning tool when the cleaning tool is not in use. The sanitizing system for toilet-cleaning implement comprises a container, liner, lid and disinfecting liquid. The disinfecting liquid is stored within the liner. The liner inserts into the container. The cleaning tool inserts into the disinfecting liquid stored in the liner. The lid encloses the container.

These together with additional objects, features and advantages of the sanitizing system for toilet-cleaning implement will be readily apparent to those of ordinary skill in the art upon reading the following detailed description of the presently preferred, but nonetheless illustrative, embodiments when taken in conjunction with the accompanying drawings.

In this respect, before explaining the current embodiments of the sanitizing system for toilet-cleaning implement in detail, it is to be understood that the sanitizing system for toilet-cleaning implement is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sanitizing system for toilet-cleaning implement.

It is therefore important that the claims be regarded as including such equivalent construction insofar as they do not depart from the spirit and scope of the sanitizing system for toilet-cleaning implement. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
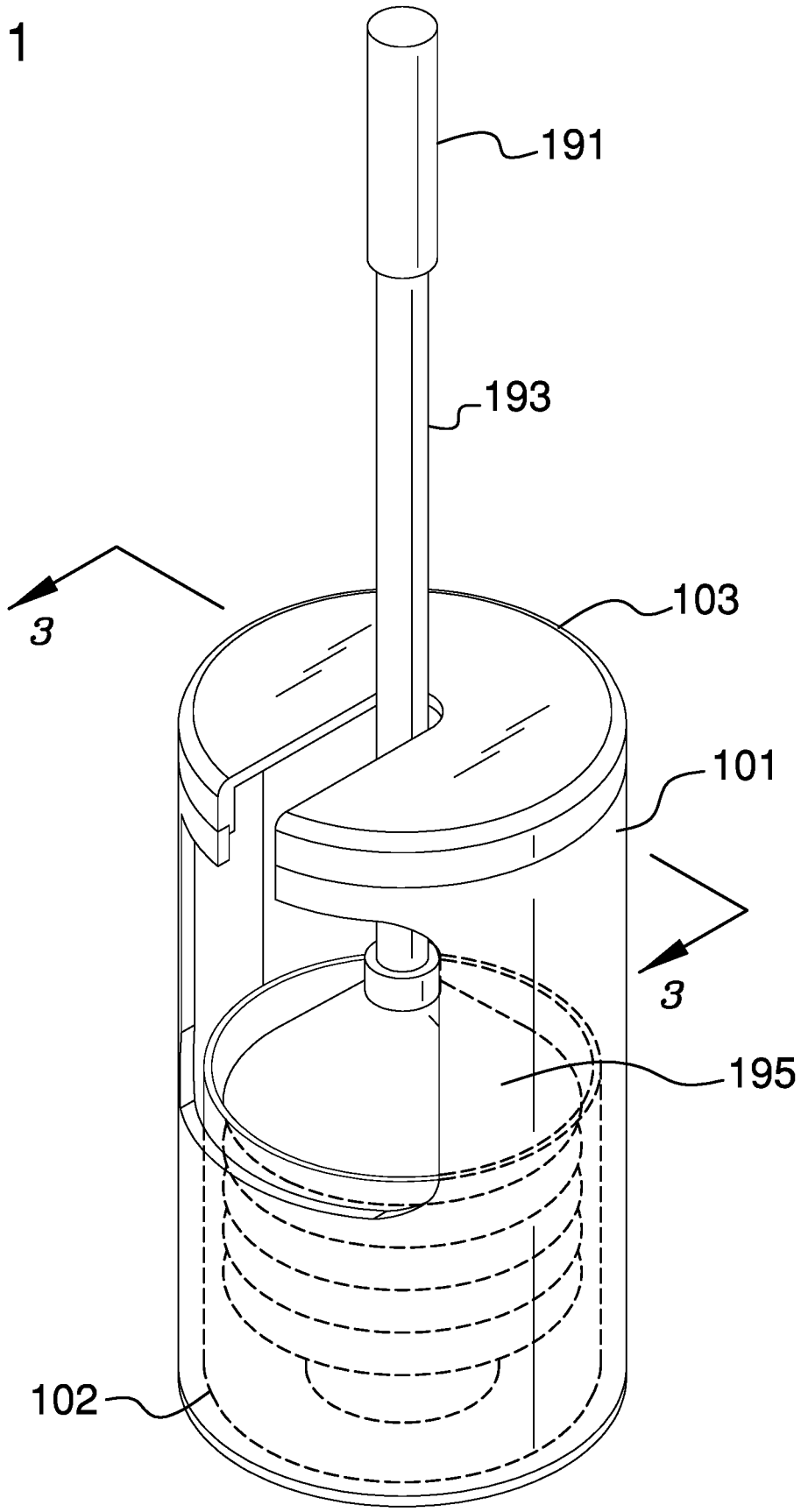
FIG. 1 is a perspective view of an embodiment of the disclosure.
Figure 2:
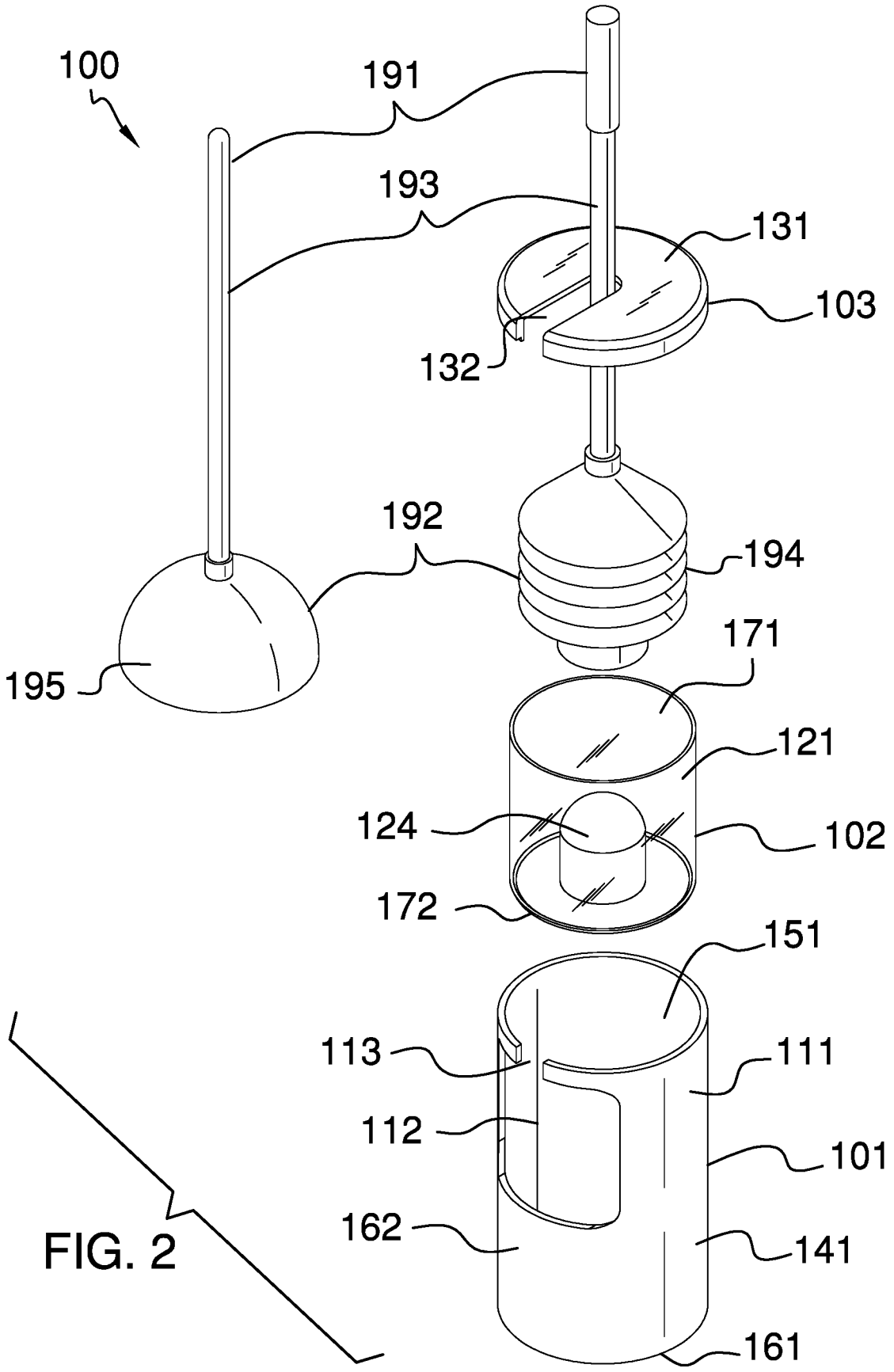
FIG. 2 is an exploded view of an embodiment of the disclosure.
Figure 3:
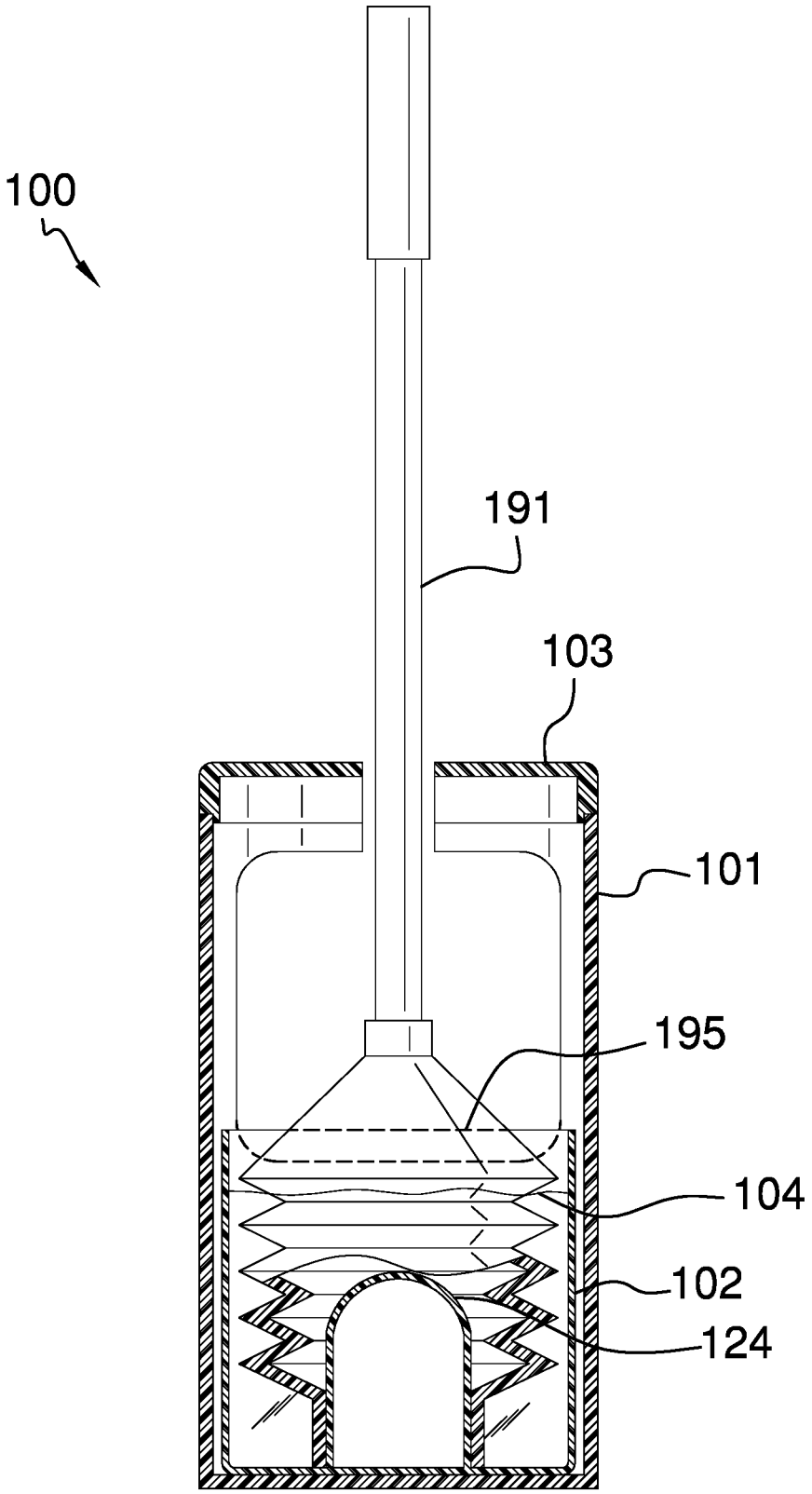
FIG. 3 is a cross-sectional view of an embodiment of the disclosure across 3-3 as shown in FIG. 1.
Figure 4:
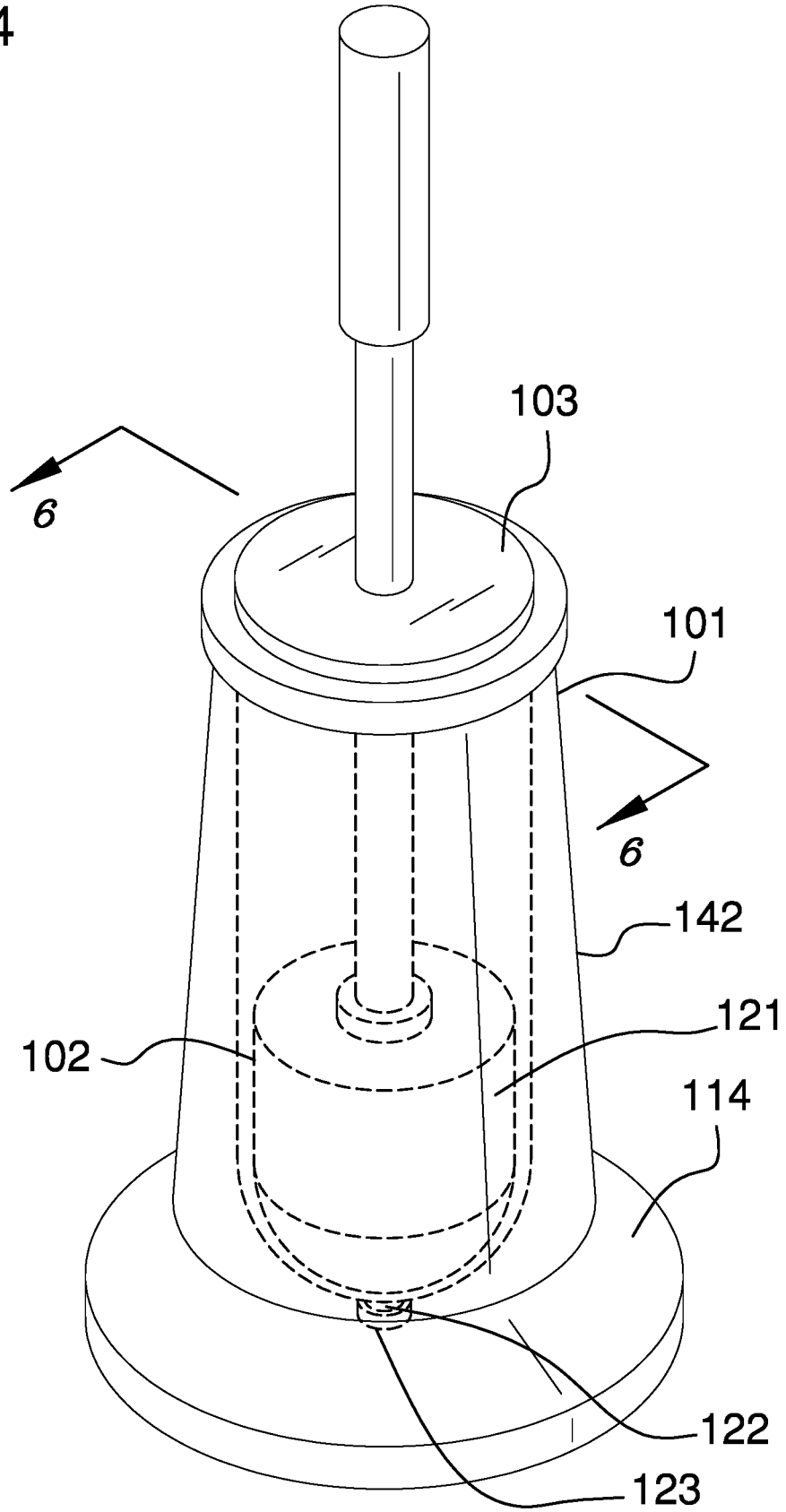
FIG. 4 is a perspective view of an alternate embodiment of the disclosure.
Figure 5:
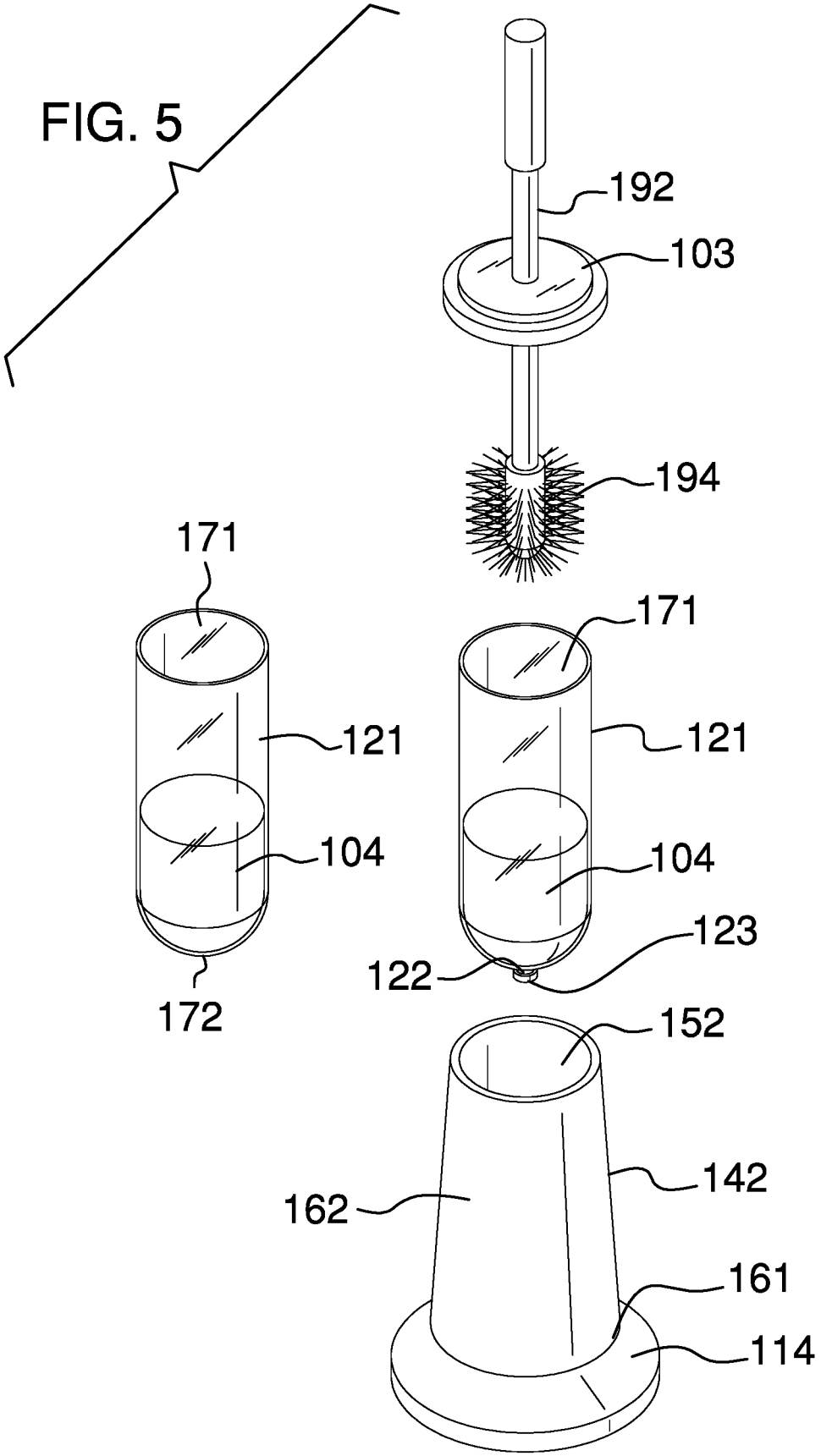
FIG. 5 is an exploded view of an alternate embodiment of the disclosure.
Figure 6:
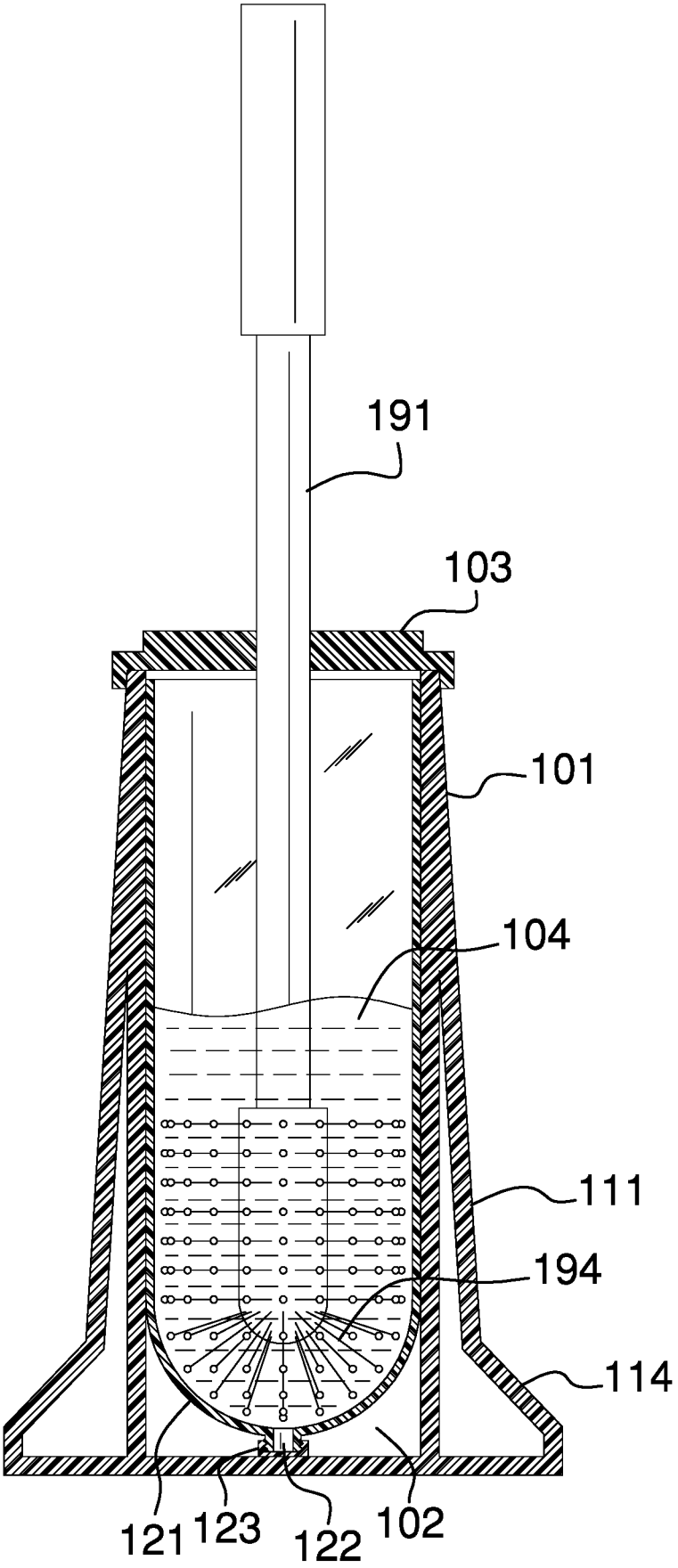
FIG. 6 is a cross-sectional view of an alternate embodiment of the disclosure across 6-6 as shown in FIG. 4.

Detailed reference will now be made to one or more potential embodiments of the disclosure, which are illustrated in FIGS. 1 through 6.

The sanitizing system for toilet-cleaning implement 100 (hereinafter invention) is a cleaning apparatus. The invention 100 is configured for use with a cleaning tool 191. The cleaning tool 191 is configured for use in cleaning toilets. The cleaning tool 191 is further defined with a working element 192 and a handle 193. The working element 192 is selected from the group consisting of a brush 194 and a plunger 195. The invention 100 stores the cleaning tool 191 when the cleaning tool 191 is not in use. The invention 100 comprises a master container 101, liner 102, lid 103 and disinfecting liquid 104. The disinfecting liquid 104 is stored within the liner 102. The liner 102 inserts into the master container 101. The working element 192 of the cleaning tool 191 inserts into the disinfecting liquid 104 stored in the liner 102. The lid 103 encloses the master container 101.

The working element 192 is defined in greater detail elsewhere in this disclosure. The handle 193 is defined in greater detail elsewhere in this disclosure. The brush 194 is defined in greater detail elsewhere in this disclosure. The plunger 195 is defined in greater detail elsewhere in this disclosure.

The disinfecting liquid 104 is a broad spectrum liquid disinfectant contained within the liner 102. The immersion of the cleaning tool 191 into the disinfecting liquid 104 destroys the biological activities of microorganisms residing on the working element 192 of the cleaning tool 191.

In the first potential embodiment of the disclosure, the disinfecting liquid 104 is selected from the group consisting of: a) a liquid solution containing N-(4-chlorophenyl)-N'-(3,4-dichlorophenyl)-urea (CAS 101-20-2); b) a liquid solution containing sodium dichloroisocyanurate (CAS 2893-78-9); and, c) a liquid solution containing sodium dichloroisocyanurate hydride (CAS 51580-86-0).

The master container 101 forms the exterior structure and boundaries of the invention 100. The master container 101 contains the liner 102 and the disinfecting liquid 104 within an enclosed environment. The master container 101 comprises an exterior shell 111, a working element slot 112, and a handle slot 113. The exterior shell 111 is further defined with a base 161 and a lateral face 162.

The base 161 refers to the closed end of the capped tube structure of the exterior shell 111 when the selected shape of the exterior shell 111 is the prism structure 141. The base 161 forms the inferior surface of the exterior shell 111. The base 161 refers to the closed base 161 of the exterior shell 111 when the selected shape of the exterior shell 111 is the truncated pyramid structure 142. The base 161 forms the inferior surface of the exterior shell 111. The lateral face 162 is defined in greater detail elsewhere in this disclosure.

The exterior shell 111 is a hollow structure. The exterior shell 111 is formed as a capped tube. The exterior shell 111 forms the exterior surfaces of the master container 101. The liner 102 and the disinfecting liquid 104 are contained in the exterior shell 111.

The shape of the exterior shell 111 is selected from the group consisting of a prism structure 141 and a truncated pyramid structure 142. The prism structure 141 refers to the shape of the exterior shell 111 when the selected shape of the exterior shell 111 is a prism. The truncated pyramid structure 142 refers to the shape of the exterior shell 111 when the selected shape of the exterior shell 111 is a truncated pyramid. Either selected structure may be rounded.

The prism structure 141 is further defined with a prism open end 151. The truncated pyramid structure 142 is further defined with a truncated apex 152. The prism open end 151 refers to the open superior end of the exterior shell 111 when the selected shape of the exterior shell 111 is the prism structure 141. The truncated apex 152 refers to the open superior end of the exterior shell 111 when the selected shape of the exterior shell 111 is the truncated pyramid structure 142.

The lid 103 encloses the exterior shell 111. The lid 103 covers an opening selected from the group consisting of: a) the prism open end 151 of the prism structure 141; and, b) the truncated apex 152 of the truncated pyramid structure 142.

The working element slot 112 is a rectilinear opening formed through the lateral face 162 of the exterior shell 111. The working element slot 112 is sized such that the working element 192 of the cleaning tool 191 will fit through the working element slot 112. The working element slot 112 allows the working element 192 of the cleaning tool 191 to pass into the hollow interior structure of the exterior shell 111.

The handle slot 113 is an opening formed through the lateral face 162 of the exterior shell 111. The handle slot 113 is sized such that the handle 193 of the cleaning tool 191 will fit through the handle slot 113. The handle slot 113 allows the handle 193 of the cleaning tool 191 to pass into the hollow interior structure of the exterior shell 111.

When the selected shape of the exterior shell 111 is the prism structure 141, the handle slot 113 forms an aperture through the prism open end 151 of the exterior shell 111. When the selected shape of the exterior shell 111 is the truncated pyramid structure 142, the handle slot 113 forms an aperture through the truncated apex 152 of the exterior shell 111.

In a second potential embodiment of the disclosure, the master container 101 further comprises a pedestal 114. The pedestal 114 is a disk-shaped structure. The base 161 of the exterior shell 111 attaches to the pedestal 114. The pedestal 114 raises the exterior shell 111 above a supporting surface. The span of the outer dimension of the pedestal 114 is greater than the outer dimension of the exterior shell 111 such that the pedestal 114 prevents the exterior shell 111 from tipping over.

The liner 102 is a containment vessel that is stored within the master container 101. The liner 102 contains the disinfecting liquid 104 such that the working element 192 of the cleaning tool 191 is stored in the disinfecting liquid 104. The liner 102 is a disposable structure that is replaced on a regularly scheduled basis for sanitary purposes. The liner 102 comprises a disinfectant tube 121, a drain aperture 122, and a drain plug 123. The disinfectant tube 121 is further defined with a tube open end 171 and a tube capped end 172.

The tube open end 171 refers to the open end of the capped tube that forms the disinfectant tube 121. The tube open end 171 forms the superior surface of the disinfectant tube 121. The tube capped end 172 refers to the closed end of the capped tube that forms the disinfectant tube 121. The tube capped end 172 forms the inferior surface of the disinfectant tube 121.

The disinfectant tube 121 is a capped tube. The outer dimension of the disinfectant tube 121 is lesser than the inner dimension of the exterior shell 111 such that the disinfectant tube 121 inserts into the exterior shell 111. The disinfectant tube 121 rests in the exterior shell 111 such that the tube capped end 172 of the disinfectant tube 121 rests on the base 161 of the exterior shell 111. The disinfectant tube 121 is a liquid impermeable structure that contains the disinfecting liquid 104 within the exterior shell 111.

The drain aperture 122 is an aperture formed in the disinfectant tube 121. The drain aperture 122 allows for the release of the disinfecting liquid 104 from the disinfectant tube 121. The drain aperture 122 is formed at a location selected from the group consisting of: a) the base 161 of the exterior shell 111; and, b) the lateral face 162 of the exterior shell 111.

The drain plug 123 is a closure that controls the drainage of the disinfecting liquid 104 through the drain aperture 122. In the first potential embodiment of the disclosure, the drain plug 123 is selected from the group consisting of a plug and a valve.

In a third potential embodiment of the disclosure, the disinfectant tube 121 further comprises a convex insert 124. The convex insert 124 is a quadric section that is formed on an interior surface of the disinfectant tube 121. The convex insert 124 is located on the base 161 of the exterior shell 111. The convex surface of the quadric structure that forms the convex insert 124 is positioned such that the convex surface of the convex insert 124 inserts into the plunger 195 of the cleaning tool 191 when the plunger 195 is selected as the working element 192 of the cleaning tool 191. The convex insert 124 forces the disinfecting liquid 104 into the plunger 195 when the cleaning tool 191 is stored in the invention 100.

The lid 103 is a removable cover that encloses the master container 101 when the cleaning tool 191 is stored in the master container 101. The lid 103 comprises a covering disk 131 and a hyoid slot 132.

The covering disk 131 is a capped tube. The inner dimension of the covering disk 131 is greater than the outer dimension of the exterior shell 111 such that the covering disk 131 fits over the exterior shell 111. When the selected shape of the exterior shell 111 is the prism structure 141, the covering disk 131 encloses the prism open end 151 of the exterior shell 111. When the selected shape of the exterior shell 111 is the truncated pyramid structure 142, the covering disk 131 encloses the truncated apex 152 of the exterior shell 111.

The hyoid slot 132 is a slot formed through the lateral face and the closed end of the capped tube that forms the covering disk 131. The hyoid slot 132 is an accommodation formed in the covering disk 131 such that the covering disk 131 will fit around the handle 193 of the cleaning tool 191.

The following definitions were used in this disclosure:

Broad Spectrum Disinfectant: As used in this disclosure, a broad spectrum disinfectant is a commercially available disinfectant that passes US Environmental Protection Agency requirements that the broad spectrum disinfectant for inhibiting the growth of gram-positive (*Staphylococcus aureus*) and gram-negative (*Salmonella enterica*) bacteria after 10 minutes or less of exposure. Broad spectrum disinfectants suitable for use with foodstuffs are commercially available.

Brush: As used in this disclosure, a brush is a device comprising a plurality of bristles set into a handle or a base that is used for grooming, sweeping, smoothing, scrubbing, or painting.

Capped Tube: As used in this disclosure, a capped tube is a tube with one closed end and one open end.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Disinfectant: As used in this disclosure, a disinfectant is a chemical that destroys or inhibits the activities of pathogenic microorganisms.

Disk: As used in this disclosure, a disk is a prism-shaped object that is flat in appearance.

Disposable: As used in this disclosure, disposable is an adjective that refers to an object that is designed and intended for a single use. Within this context, an object would be considered disposable if it is not reusable after its initial use.

Drain: As used in this disclosure, a drain is a fitting that is used to remove a fluid from a structure.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Fitting: As used in this disclosure, a fitting is a component that is attached to a first object. The fitting is used to forming a fluidic connection through the first object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals one.

Grip: As used in this disclosure, a grip is an accommodation formed on or within an object that allows the object to be grasped or manipulated by a hand.

Hand Tool: As used in this disclosure, a hand tool refers to a tool that is small and light enough to allow a person to hold the tool during use.

Handle: As used in this disclosure, a handle is an object by which a tool, object, or door is held or manipulated with the hand.

Hyoid: As used in this disclosure, a hyoid refers to a three-sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of the length of the first arm roughly equals the span of the length of the second arm. Hyoids generally have a U shaped appearance.

Inner Dimension: As used in this disclosure, the term inner dimension describes the span from a first inside or interior surface of a container to a second inside or interior surface of a container. The term is used in much the same way that a plumber would refer to the inner diameter of a pipe.

Lid: As used in this disclosure, a lid is a removable cover that is placed over an opening of a hollow structure to enclose the hollow structure.

N-(4-chlorophenyl)-N'-(3,4-dichlorophenyl)-urea: As used in this disclosure, N-(4-chlorophenyl)-N'-(3,4-dichlorophenyl)-urea (CAS 101-20-2) is an antibacterial agent commonly found in soaps. N-(4-chlorophenyl)-N'-(3,4-dichlorophenyl)-urea is commonly called triclocarban.

Negative Space: As used in this disclosure, negative space is a method of defining an object through the use of open or empty space as the definition of the object itself, or, through the use of open or empty space to describe the boundaries of an object.

Nested Structure: As used in this disclosure, a nested structure refers to a plurality of geometrically similar objects wherein a smaller geometrically similar object can be contained or stored within a larger geometrically similar object. When used as a verb, to nest refers to the arrangement of a plurality of geometrically similar objects into a nested structure.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pedestal: As used in this disclosure, a pedestal is an intermediary load bearing structure that that transfers a load path between a supporting surface and an object, structure, or load.

Plug: As used in this disclosure, a plug is an object that is used as a barrier to block access to a cavity or an aperture.

Plunger: As used in this disclosure, a plunger is a hand tool that is used to clear a blocked pipe in a plumbing system. The plunger comprises a bulb formed from an elastomeric material and a handle. The handle manipulates the bulb such that the volume in the bulb changes in such a manner that pressure differentials are created within the plumbing system. The generated pressure differentials provided the force required to dislodge the material blocking the pipe.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pyramid: As used in this disclosure, a pyramid is a three-dimensional shape that comprises a base formed in the shape of an N-gon (wherein N is an integer) with N triangular faces that rise from the base to converge at a point above the base. If the point where the N faces meet is positioned such that a line drawn from the point where the N faces meet to the center of the N-gon base is perpendicular to the N-gon base, the pyramid is referred to as a right pyramid. Pyramids can be further formed with circular or elliptical bases which are commonly referred to as cone or an elliptical pyramid respectively. A pyramid is defined with a base, an apex, and a lateral face. The base is the N-gon shaped base described above. The apex is the convergence point described above. The lateral face is formed from the N triangular faces described above.

Quadric Section: As used in this disclosure, a quadric section refers either one of the two objects formed by the bifurcation of a quadric by a bifurcating plane that passes through the center axis of the structure contained by quadric surface. A right quadric section occurs when the bifurcating plane intersects the center axis of the quadric surface. A quadric semi-section occurs when the bifurcating plane contains the center axis of the quadric surface. The angle of the quadric section is the angle formed between the bifurcating plane and the center axis of the quadric surface.

Quadric Surface: As used in this disclosure, a quadric surface is a three-dimensional surface that varies in the three Cartesian coordinates in an algebraically defined manner that is related to conic sections. Euclidian planes as well as the surfaces of ellipsoids, spheres, paraboloids, and cones are examples of quadric surfaces. The Euclidian plane is technically considered a degenerate form of a quadric surface but, unless specifically stated otherwise within this disclosure, is explicitly included in this definition. Quadric surfaces are described by the general algebraic form: $Ax^2+By^2+Cz^2+Dxy+Exz+Fyz+Gx+Hy+Iz+J=0$.

Rounded: A used in this disclosure, the term rounded refers to the replacement of an apex, vertex, or edge or brink of a structure with a (generally smooth) curvature wherein the concave portion of the curvature faces the interior or center of the structure.

Sodium Dichloroisocyanurate: As used in this disclosure, sodium dichloroisocyanurate is a commonly used name for sodium 3,5-dichloro-2,4,6-trioxy,1,3,5-triazinan-1-ide (CAS 2893-78-9). Sodium dichloroisocyanurate is a commonly used disinfecting agent that is available in a powder form. Sodium dichloroisocyanurate is soluble in water and alcohol. Sodium dichloroisocyanurate is also available in a dihydride formulation (sodium dichloroisocyanurate hydride (CAS 51580-86-0)).

Slot: As used in this disclosure, a slot is a long narrow cut or opening formed in or through an object.

Spherical Section: As used in this disclosure, a spherical section refers one of the two objects formed by the bifurcation of a sphere by a plane that does not pass through the center of the sphere. The major section is the spherical section that contains the larger volume. The minor section is the spherical section that contains the smaller volume. A spherical section is commonly called a spherical cap.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Tool: As used in this disclosure, a tool is a device, an apparatus, or an instrument that is used to carry out an activity, operation, or procedure.

Truncated: As used in this disclosure, a geometric object is truncated when an apex, vertex, or end is cut off by a line or plane.

Truncated Pyramid: As used in this disclosure, a truncated pyramid is a frustum that remains when the apex of a pyramid is truncated by a plane that is parallel to the base of the pyramid. The truncated pyramid is defined by the base, the lateral face, and the truncated apex. The definition of the base and the lateral face correspond to the same terms in a pyramid. The truncated apex refers to the surface that is distal from the base.

Tube: As used in this disclosure, the term tube is used to describe a rigid hollow prism with two open ends. While tubes that are suitable for use in this disclosure are often used to transport or conveys fluids or gases, the purpose of the tubes in this disclosure is structural. In this disclosure, the terms inner dimension and outer dimension of a tube are used as they would be used by those skilled in the plumbing arts.

Valve: As used in this disclosure, a valve is a device that is used to control the flow of a fluid (gas or liquid) through a pipe.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A sanitizing apparatus comprising
a master container, liner, lid and disinfecting liquid;
wherein the disinfecting liquid is stored within the liner;
wherein the liner inserts into the master container;
wherein the lid encloses the master container;
wherein the sanitizing apparatus is configured for use with a cleaning tool;
wherein the cleaning tool further comprises a working element and a handle;
wherein the working element attaches to the handle;
wherein the working element is selected from the group consisting of a brush and a plunger;
wherein the sanitizing apparatus stores the cleaning tool;
wherein the liner comprises a disinfectant tube, a drain aperture, and a drain plug;
wherein the drain aperture and the drain plug are formed in the disinfectant tube;
wherein the disinfectant tube is further defined with a tube open end and a tube capped end;
wherein the tube open end forms the superior surface of the disinfectant tube.

2. The sanitizing apparatus according to claim 1 wherein the working element of the cleaning tool inserts into the disinfecting liquid stored in the liner.

3. The sanitizing apparatus according to claim 2 wherein the disinfecting liquid is a broad spectrum liquid disinfectant.

4. The sanitizing apparatus according to claim 3
wherein the master container forms the exterior structure and boundaries of the sanitizing apparatus;
wherein the master container contains the liner and the disinfecting liquid within an enclosed environment;
wherein the liner is a containment vessel;
wherein the liner is a disposable structure;
wherein the lid is a removable cover.

5. The sanitizing apparatus according to claim 4
wherein the master container comprises an exterior shell, a working element slot, and a handle slot;
wherein the working element slot and the handle slot are formed in the exterior shell;
wherein the exterior shell is further defined with a base and a lateral face;
wherein the base forms the inferior surface of the exterior shell.

6. The sanitizing apparatus according to claim 5
wherein the exterior shell is a hollow structure;
wherein the exterior shell is formed as a capped tube;
wherein the exterior shell forms the exterior surfaces of the master container;
wherein the liner and the disinfecting liquid are contained in the exterior shell.

7. The sanitizing apparatus according to claim 6
wherein the shape of the exterior shell is selected from the group consisting of a prism structure and a truncated pyramid structure;
wherein the base refers to the closed end of the capped tube structure of the exterior shell when the selected shape of the exterior shell is the prism structure;
wherein the base refers to the closed base of the exterior shell when the selected shape of the exterior shell is the truncated pyramid structure;
wherein the prism structure is further defined with a prism open end;
wherein the truncated pyramid structure is further defined with a truncated apex.

8. The sanitizing apparatus according to claim 7
wherein the prism open end refers to an open superior end of the exterior shell when the selected shape of the exterior shell is the prism structure;
wherein the truncated apex refers to an open superior end of the exterior shell when the selected shape of the exterior shell is the truncated pyramid structure.

9. The sanitizing apparatus according to claim 8
wherein the lid encloses the exterior shell;
wherein the lid covers an opening selected from the group consisting of: a) the prism open end of the prism structure; and, b) the truncated apex of the truncated pyramid structure.

10. The sanitizing apparatus according to claim 9
wherein the working element slot is a rectilinear opening formed through the lateral face of the exterior shell;
wherein the working element slot is sized such that the working element of the cleaning tool will fit through the working element slot.

11. The sanitizing apparatus according to claim 10
wherein the handle slot is an opening formed through the lateral face of the exterior shell;
wherein the handle slot is sized such that the handle of the cleaning tool will fit through the handle slot;
wherein when the selected shape of the exterior shell is the prism structure, the handle slot forms an aperture through the prism open end of the exterior shell;
wherein when the selected shape of the exterior shell is the truncated pyramid structure, the handle slot forms an aperture through the truncated apex of the exterior shell.

12. The sanitizing apparatus according to claim 11
wherein the disinfectant tube is a capped tube;
wherein the outer dimension of the disinfectant tube is lesser than the inner dimension of the exterior shell such that the disinfectant tube inserts into the exterior shell;
wherein the disinfectant tube rests in the exterior shell such that the tube capped end of the disinfectant tube rests on the base of the exterior shell;
wherein the disinfectant tube is a liquid impermeable structure.

13. The sanitizing apparatus according to claim 12 wherein the drain aperture is an aperture formed in the disinfectant tube;

wherein the drain aperture is formed at a location selected from the group consisting of: a) the base of the exterior shell; and, b) the lateral face of the exterior shell.

14. The sanitizing apparatus according to claim 13 wherein the drain plug is a closure that controls the drainage of the disinfecting liquid through the drain aperture.

15. The sanitizing apparatus according to claim 14 wherein the lid comprises a covering disk and a hyoid slot;

wherein the hyoid slot is formed in the covering disk;

wherein the inner dimension of the covering disk is greater than the outer dimension of the exterior shell such that the covering disk fits over the exterior shell.

16. The sanitizing apparatus according to claim 15 wherein the covering disk is a capped tube;

wherein the hyoid slot is a slot formed through the lateral face and the closed end of the capped tube that forms the covering disk;

wherein the hyoid slot is in the covering disk such that the covering disk will fit around the handle of the cleaning tool;

wherein when the selected shape of the exterior shell is the prism structure, the covering disk encloses the prism open end of the exterior shell;

wherein when the selected shape of the exterior shell is the truncated pyramid structure, the covering disk encloses the truncated apex of the exterior shell.

17. The sanitizing apparatus according to claim 16 wherein the disinfectant tube further comprises a convex insert;

wherein the convex insert is a quadric section;

wherein the convex insert is formed on the base of the exterior shell;

wherein the convex surface of the quadric structure that forms the convex insert is positioned such that the convex surface of the convex insert inserts into the plunger of the cleaning tool when the plunger is selected as the working element of the cleaning tool.

18. The sanitizing apparatus according to claim 17 wherein the disinfecting liquid is selected from the group consisting of: c) a liquid solution containing n-(4-chlorophenyl)-n'-(3,4-dichlorophenyl)-urea (CAS 101-20-2); d) a liquid solution containing sodium dichloroisocyanurate (CAS 2893-78-9); and, e) a liquid solution containing sodium dichloroisocyanurate hydride (CAS 51580-86-0).

19. The sanitizing apparatus according to claim 18 wherein the master container further comprises a pedestal;

wherein the pedestal is a disk-shaped structure;

wherein the base of the selected exterior shell attaches to the pedestal;

wherein the span of the outer dimension of the pedestal is greater than the outer dimension of the exterior shell.

* * * * *